United States Patent [19]

Friedman

[11] 4,012,010

[45] Mar. 15, 1977

[54] THREAD DISPENSER

[76] Inventor: Robert W. Friedman, 159 Reynolds Road, West Islip, N.Y. 11795

[22] Filed: Dec. 2, 1975

[21] Appl. No.: 636,923

[52] U.S. Cl. ..... 242/129.8; 242/96

[51] Int. Cl.[2] ..... B65H 49/00

[58] Field of Search ..... 242/129.8, 137.1, 96, 242/55.53; 132/91, 92 R, 92 A; 128/340

[56] References Cited

UNITED STATES PATENTS

| | | | |
|---|---|---|---|
| 1,545,399 | 7/1925 | Clennan | 242/55.53 |
| 2,738,140 | 3/1956 | Thompson | 242/129.8 |
| 2,808,055 | 10/1957 | Thayer | 128/340 |
| 3,361,382 | 1/1968 | Converse | 242/137.1 |
| 3,827,653 | 8/1974 | Taylor | 242/137.1 |
| 3,831,611 | 8/1974 | Hendricks | 132/92 R |

*Primary Examiner*—Leonard D. Christian
*Attorney, Agent, or Firm*—Jack D. Slobod

[57] ABSTRACT

A thread dispenser for string art includes an elongated frustoconical tubular handgrip having front and rear ends of respectively relatively larger and relatively smaller diameters. A wire projecting radially from the rear end of the handgrip has a sinous bend intermediate its length serving as a land for a spool of thread and a straight end for carrying the spool. A notch through the wall of the handgrip at a point intermediate its length has opposed intersecting cross sectional and rearwardly inclined surfaces. Thread from the spool is trained through the notch and out the front end and the thumb of the operator gripping the handgrip in the nature of a pen serves as a brake by pressing the thread against the rearwardly inclined surface.

3 Claims, 3 Drawing Figures

THREAD DISPENSER

FIELD OF THE INVENTION

The present invention relates generally to thread dispensing devices. In its particular aspects, the present invention relates to a device proportioned to be gripped like a pen which dispenses thread from its end.

BACKGROUND OF THE INVENTION

In a well known form of string art, a plurality of nails are set upstanding in a board and colored thread is serially wound about and between the nails to produce a decorative pattern. When the nails are spaced close together, it is quite difficult and time consuming to wind the thread.

OBJECTS OF THE INVENTION

It is an object of the present invention to provide a thread dispensing tool capable of being manipulated between closely spaced string art supporting nails for winding the thread about the nails.

It is a further object of the present invention to provide a simple and inexpensive pen shaped device for dispensing thread out its end.

SUMMARY OF THE INVENTION

Briefly, the aforementioned and other objects of the present invention are satisfied by providing a thread dispensing device for string art which includes an elongated tubular handgrip proportioned to be gripped in the nature of a pen.

The handgrip tapers in diameter along its length between front and rear ends respectively of relatively smaller and relatively larger diameters. A wire arm is secured to the rear end of the handgrip and extends radially therefrom. The wire has a sinous bend intermediate its length serving as a land for a spool of thread received on a straight end of the wire.

A notch is provided through the wall of the handgrip at a location intermediate its length. The notch has a cross-sectional surface and a rearwardly inclined surface intersecting the cross-section surface in a V.

The thread is trained from the spool, through the notch, and out the front end of the handgrip. A thumb may press the thread against the rearwardly inclined surface of the notch for a breaking action to control the deployment of the thread from the front end of the handgrip as the device is manipulated for winding the thread about string art supporting nails.

Other objects, features and advantages of the present invention will become apparent upon perusal of the following detailed description of the preferred embodiment thereof when taken in conjunction with the appended drawing wherein.

DETAILED DESCRIPTION

Figure 1:
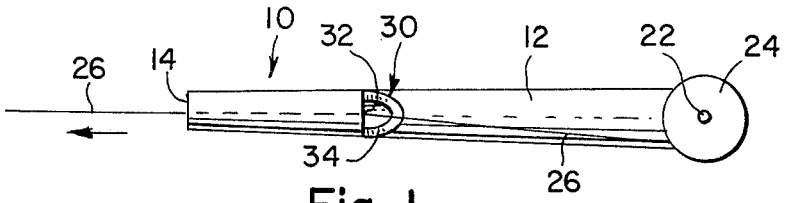
FIG. 1 is a top view of the thread dispensing device of the present invention.
Figure 2:
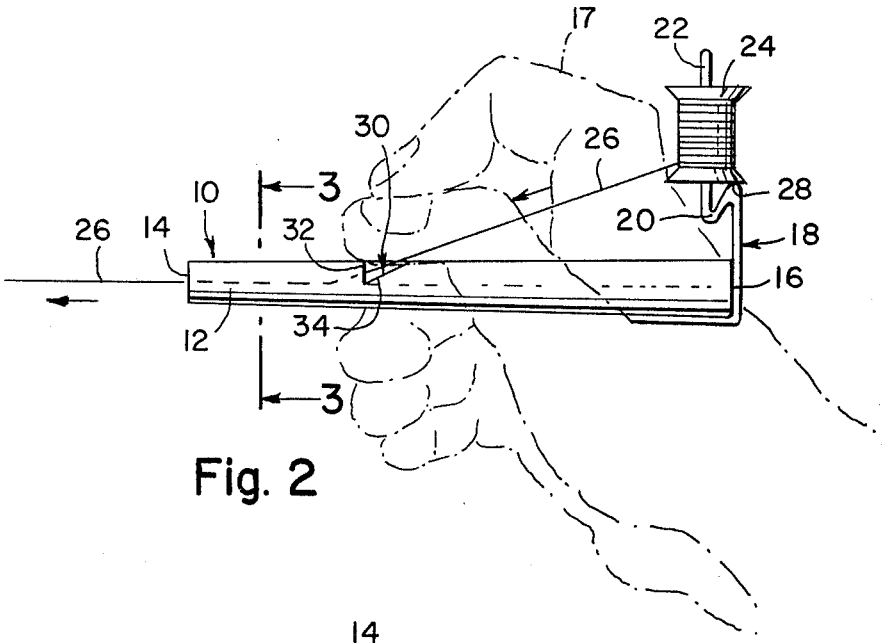
FIG. 2 is a side elevational view of the thread dispensing device in FIG. 1 depicting how the device is held in a hand.
Figure 3:
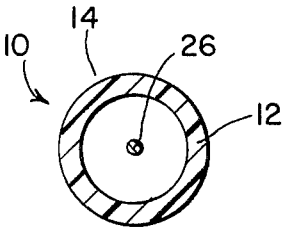
FIG. 3 is a cross-sectional view through the lines 3—3 in FIG. 2.

Referring to FIGS. 1 through 3 of the drawing, the thread dispensing device of the present invention is generally indicated by the reference numeral 10. Dispenser 10 includes an elongated tubular frusto-conical body or handgrip 12 having a small diameter end 14 and a large diameter end 16. The body 12 is proportioned to be gripped by a hand 17 in the nature of a pen as if end 14 were the writing end. Conveniently, body 12 is a ball point pen body with the usual writing insert removed.

At end 16, a stiff wire 18 is secured and projects generally radially of body 12. The wire 18 has a sinous bend 20 at a point intermediate its length. The bend 20 defines a straight portion 22 at the end of wire 18 for receiving a spool 24 of thread 26 as an axle and a land 28 forming the bottom of portion 22 for supporting the bottom of spool 24.

At a point intermediate the length of body 12 a notch 30 is formed through the wall of the body. The notch 30 is located on the same side of body 12 as the end portion 22 of wire 18 and is formed as a V by the intersection of a cross-sectional surface 32 approximately half way through body 12 and a rearwardly inclined surface 34 which exposes the surfaces 32 to face end 16. In the event body 12 comprises a ball point pen body the notch 30 is formed by cutting a wedge from the body.

The thread 26 is trained from spool 24 through notch 30 and into the interior of body 12. The thread exits body 12 at front end 14.

In the use of the dispenser 10, body 12 is gripped as a pen by hand 17, and the front end 14 is manipulated between upstanding nails (not shown) for string art. The thread 26 which exits front end 14 is wrapped about the nails and run between the nails to form a decorative pattern. The thumb of hand 17 is easily maintained pressing thread 26 against the periphery of inclined notch surface 34 to act as a brake. This action enables thread to be pulled from front end 14 only when desired. The thumb is positioned as a brake during the winding of the thread about a nail and is removed from this position when the dispenser 10 is moved from one nail to the next for deploying thread at that time.

While the preferred embodiment of the present invention has been described in specific detail, it should be understood that numerous modifications, additions and omissions in the details thereof are possible within the intended spirit and scope of the invention claimed herein.

What is claimed is:

1. A device for dispensing thread from a spool comprising: an elongated tubular handgrip tapering in diameter along its length between front and rear ends respectively of relatively smaller and relatively larger diameter; said handgrip having a notch through its wall at a location intermediate said front and rear ends; said handgrip being proportioned to be gripped in the nature of a pen; a wire secured to the rear end of said handgrip and extending radially of said handgrip, said wire being bent to support said spool of thread at its end; whereby said thread from said spool may be trained through said notch into the interior of said handgrip and out said front end.

2. The device of claim 1 wherein said notch has intersecting cross-sectional and rearwardly inclined surfaces, said cross-sectional surface facing said rear end.

3. The device of claim 1 wherein said wire has a sinous bend intermediate its length defining a straight end of said wire for receiving said spool and a land below said straight end for supporting said spool.

* * * * *